United States Patent [19]

McGowan

[11] Patent Number: 4,954,015

[45] Date of Patent: Sep. 4, 1990

[54] GUTTER SEAL

[75] Inventor: Vince J. McGowan, Thornton, Canada

[73] Assignee: GSW Inc., Barrie, Canada

[21] Appl. No.: 503,936

[22] Filed: Apr. 4, 1990

[51] Int. Cl.[5] ..... E02B 5/00

[52] U.S. Cl. ..... 405/121; 52/11; 405/119

[58] Field of Search ..... 405/118, 119, 121, 122, 405/123; 52/11, 16

[56] References Cited

U.S. PATENT DOCUMENTS 3,253,415 5/1966 Davidson ..... 405/119
4,257,716 3/1981 Woodrow ..... 405/118

FOREIGN PATENT DOCUMENTS 435650 10/1967 Switzerland ..... 405/121

*Primary Examiner*—David H. Corbin

[57] ABSTRACT

The present invention relates to an eavestrough fitting having a molded plastic member with a gasket secured thereto having a unique configuration. The gasket has at least two ribs extending across the molded plastic member and up the sides thereof, with these ribs being sized to form a seal with an appropriately shaped eavestrough inserted within the fitting. The eavestrough is inserted into the fitting and the gasket includes resilient aligning members urging the sidewalls of the inserted eavestrough towards the center whereby the base of the eavestrough is more positively urged into sealing contact with the ribs across the base of the molded plastic member.

15 Claims, 2 Drawing Sheets

GUTTER SEAL

FIELD OF THE INVENTION

The present invention relates to an improved eavestrough fitting, in particular, a molded plastic eavestrough fitting having a gasket secured thereto with the gasket having a unique configuration for accurately retaining an appropriately shaped eavestrough inserted therein in sealing engagement.

BACKGROUND OF THE INVENTION

A number of eavestrough systems are currently marketed and in the do-it-yourself market, there are two basic types of systems. The first system is a solvent welded or secured system where plastic pieces are inserted, one into the other and then adhered, to provide a positive securement and seal therebetween. The second type of system involves fittings and eavestrough where the eavestrough snaps into the respective fitting, and the fitting includes a gasket member for providing a seal with the outer surface of the eavestrough. Examples of this second type of system are shown in U.S. Pat. No. 4,257,716.

Any system which uses plastic eavestrough must be of a design to allow for thermal expansion and contraction of the eavestrough with changing ambient temperature. This thermal expansion is accommodated in the second type of system by providing within the fitting room for thermal expansion of the eavestrough whereby the eavestrough moves within the fitting with the gasket maintaining the seal. Thus, the gasket accommodates the moving of the eavestrough within the fitting.

Problems can occur with respect to moving seal systems due to the movement of the eavestrough and due to forces exerted on the base of certain eavestrough, as disclosed herein and in U.S. Pat. No. 4,257,716. This base can bow upwardly, partially due to the shape of the eavestrough and the manner in which the eavestrough is snap fitted into the fitting. The bowing of the base of the eavestrough is also compounded by thermal expansion of the eavestrough during the hot summer months which provides additional stress on the walls of the eavestrough, resulting in the base portion bowing generally in the center of the eavestrough fitting.

SUMMARY OF THE INVENTION

An eavestrough fitting, according to the present invention, comprises a molded plastic member having secured thereto a gasket. The gasket has at least two ribs extending across the member and up the sides thereof. The ribs are sized to form a seal with an appropriately eavestrough inserted within the fitting. The molded plastic member has a generally flat base connected to outwardly angled sidewalls which terminate in a short vertical section. The gasket conforms to the shape of the molded plastic member and includes resilient aligning members associated with the ribs either side of the base on the outwardly angled sidewalls. These resilient aligning members center the eavestrough within the fitting and urge the sidewalls of an inserted eavestrough towards the center of the fitting, stressing the base of the inserted eavestrough in a manner to urge the base into sealing contact with the underlying ribs.

The present invention is also directed to the molded eavestrough fitting, as generally described above, in combination with a similarly shaped length of eavestrough. This combination cooperates to provide an effective seal between the fitting and the eavestrough.

BRIEF DESCRIPTION OF THE DRAWINGS

Preferred embodiments of the invention are shown in the drawings, wherein.

DETAILED DESCRIPTION OF THE PREFERRED EMBODIMENTS

Figure 1:
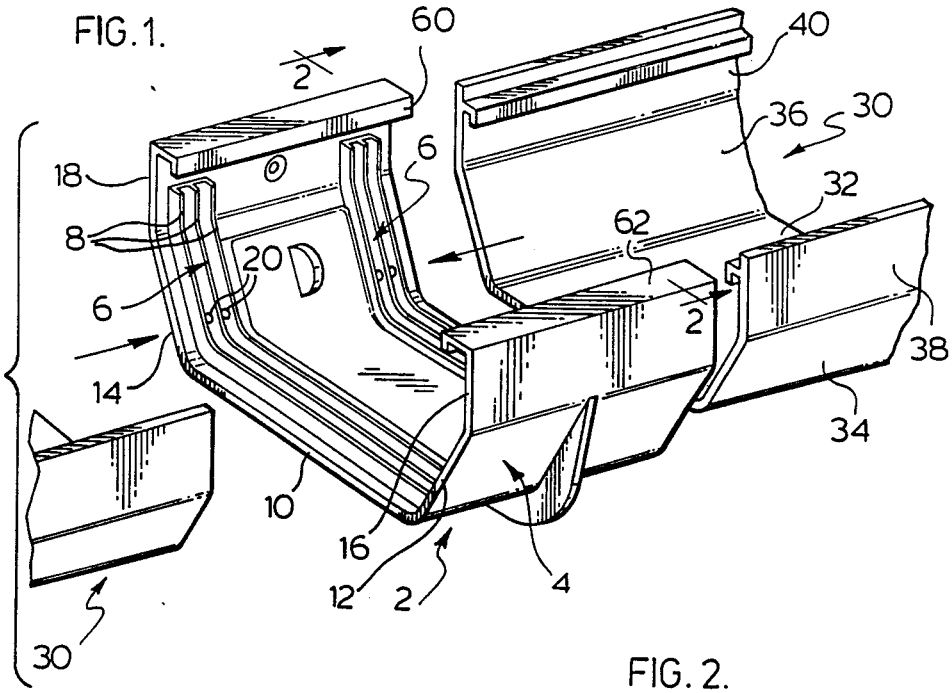
FIG. 1 is a partial perspective view of two lengths of eavestrough being inserted into a molded plastic fitting.
Figure 2:
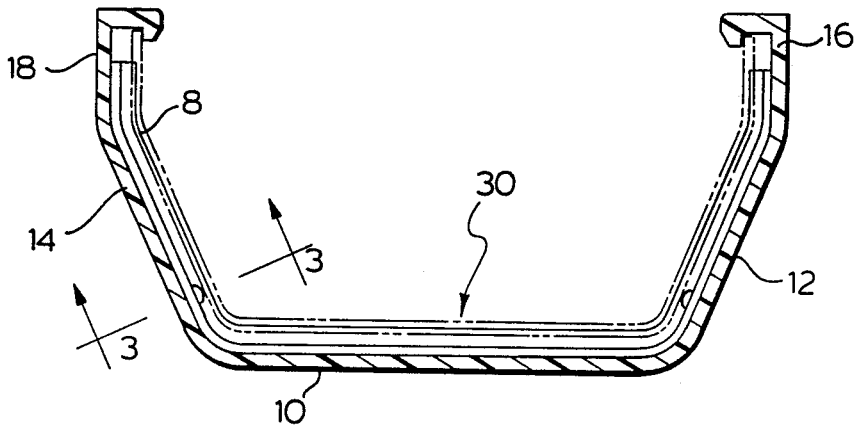
FIG. 2 is a vertical section taken along line 2—2 of FIG. 1.

As shown in the drawings, the eavestrough fitting 2 comprises a molded plastic member 4 having a gasket member 6 secured on the interior surface thereof and conforming to the shape of the molded plastic member. The molded plastic member has a flat base 10, outwardly angled sidewalls 12 and 14 which terminate in respective short vertical sections 16 and 18.

The gasket 6 includes three parallel ribs 8 which each form a wiper seal with the lower surface of an inserted eavestrough. The eavestrough 30 has a flat base 32, outwardly angled sidewalls 34 and 36 which respectively terminate in short vertical sections 38 and 40. The gasket, in addition to having the three ribs 8, includes resilient aligning members 20, in this case in the form of circular teats which are within one inch of the base 10 of the fitting 2. Preferably, these resilient aligning members are placed within one-half inch of the base. The resilient aligning members 20 are associated with the ribs 8 preferably, intermediate the ribs with two resilient aligning members positioned at each side of the base 10.

The gaskets 8 are injection moulded directly on the fitting 2 and have a thin layer at the fitting which joins the ribs and secures the gasket to the fitting.

Figure 3:
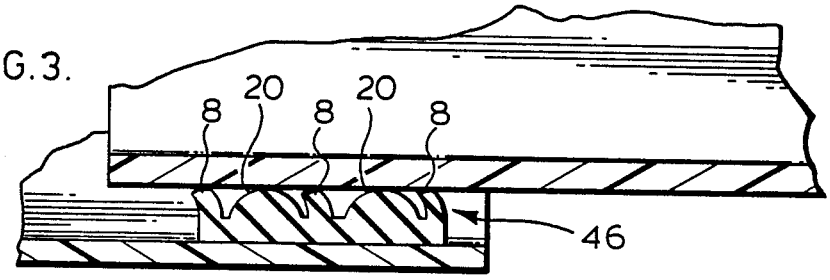
FIG. 3 is a sectional view taken along line 3—3 of FIG. 2.
Figure 4:
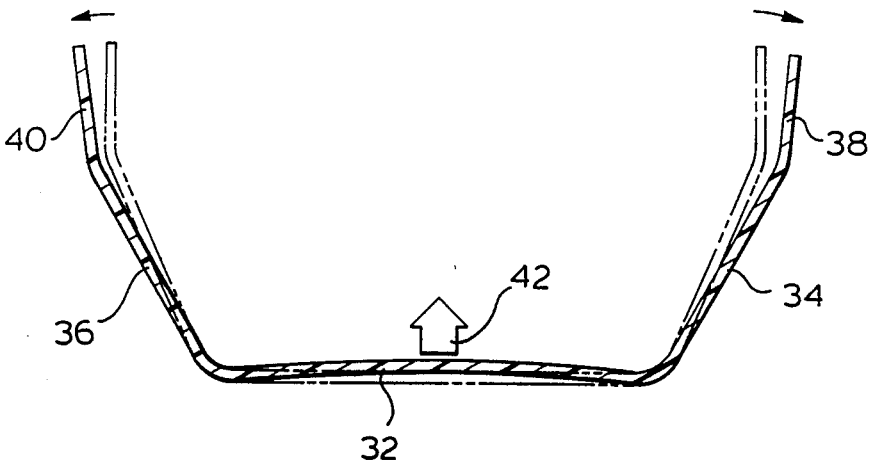
FIG. 4 is a sectional view of a length of eavestrough showing a tendency thereof.

Gasket members having ribs of this type have been used before, however, they do not include the resilient aligning members 20. It has been found that these resilient aligning members apply a force on the sidewalls 34 and 36, as generally shown in 35, which urge the sidewalls towards the center of the eavestrough, resulting in a downward deflection of the eavestrough base 32 as generally indicated by arrow 48. This downward deflection is the result of the force urging the sidewalls 34 and 36 inwardly. It should be noted that there is a cooperation between the ribs 8 and the resilient aligning members 20, as generally shown in FIG. 3, where the resilient aligning members have deformed and cooperate with the compressed ribs 8 to provide a ridge, generally indicated as 46, of high pressure on the sidewalls of the eavestrough adjacent the resilient aligning members to cause this inward deflection. These resilient aligning members 20 also serve to maintain the eavestrough 30 aligned or centered within the fitting 2. In some circumstances, there previously was a tendency for the eavestrough to become off-centered, resulting in a gap at one side of the fitting or the other. The resilient aligning members 20 prevent this and maintain the center position of the eavestrough within the fitting. This advantage is of particular benefit, as it must be appreciated that the eavestrough moves within the fitting due to thermal expansion and thus, alignment and the continuous contact of the ribs 8 with the eavestrough are important. The resilient aligning members 20 thus reduce the tendency of the base 32 of the eavestrough 30 to bow upwardly, as generally shown at 42 in FIG. 4, while also serving to maintain alignment of the eavestrough within the particular fitting it is associated with. The resilient aligning members are preferably about 50% of the uncompressed height of the ribs.

In FIG. 1, the eavestrough 30 has been shown as sliding into the fitting 2, however, in most cases, there is a snap fit where one edge of the eavestrough is first hooked under the lip 60 of the fitting 2 and the eavestrough is then forced below the opposite lip 62 of the fitting. It can be appreciated that with this type of action, the centering of the resilient aligning members 20 is important due to the high load that the one side of the fitting will encounter during the snap fitting of the eavestrough into the fitting.

The invention has been described with respect to the joiner fitting 2, shown in FIG. 1, which has two gaskets 8 either side thereof. There are other fittings which are similar in having two gaskets, such as fittings having a downpipe connection, 90 degree corner members, etc. There are also other fittings only having a single gasket, such as an end cap, a blind downspout, etc. Therefore, the term "fitting" is used broadly to include both fittings designed to receive eavestroughs at either side thereof as well as fittings which merely are designed to engage one length of eavestrough.

Figure 5:
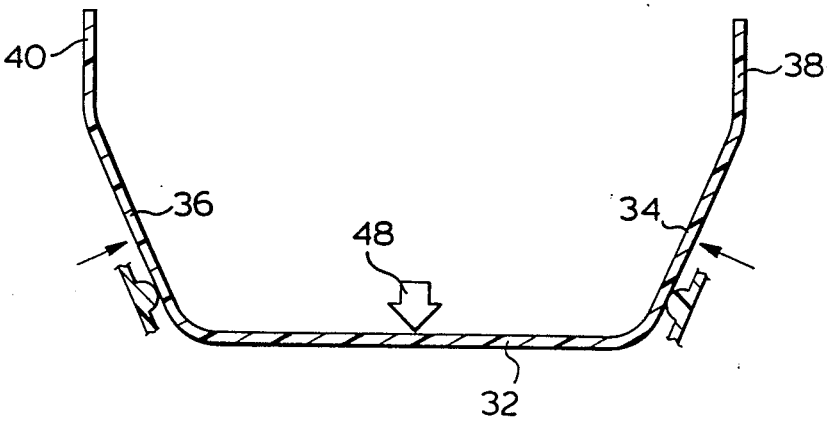
FIG. 5 is a sectional view illustrating how the resilient aligning members act on the sidewalls of the eavestrough.
Figure 6:
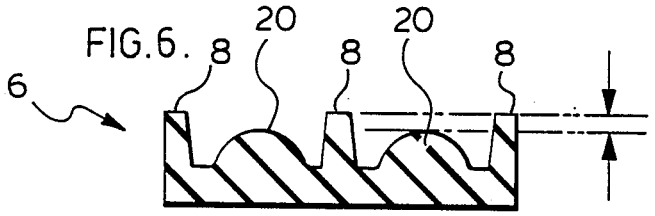
FIG. 6 is an enlarged view of the improved gasket of the eavestrough fitting.

In reviewing FIG. 3, it can be appreciated that the ribs 8 deform and compress under load and, similarly, the resilient aligning members 20 also deform and compress, resulting in the pressure ridge 46 generally extending across the eavestrough immediately adjacent the resilient aligning members 20. This provides a distributed force on the sidewalls which results in a tendency for the base to move downwardly in the direction of arrow 48 as shown in FIG. 5. This force will continue over the life of the system while accommodating the necessary movement of the eavestrough 30 within the fitting 2.

Although various preferred embodiments of the present invention have been described herein in detail, it will be appreciated by those skilled in the art, that variations may be made thereto without departing from the spirit of the invention or the scope of the appended claims.

THE EMBODIMENTS OF THE INVENTION IN WHICH AN EXCLUSIVE PROPERTY OR PRIVILEGE IS CLAIMED ARE DEFINED AS FOLLOWS:

1. An eavestrough fitting comprising a moulded plastic member having secured thereto a gasket, said gasket having at least two ribs extending across said member and up the sides thereof, said ribs being sized to form a seal with an appropriately shaped eavestrough inserted within said fitting, said moulded plastic member having a generally flat base connected to outwardly angled sidewalls which terminate in a short vertical section, said gasket conforming to the shape of said moulded plastic member and including resilient aligning members associated with said ribs either side of said base on said outwardly angled sidewalls, said resilient aligning members urging the sidewalls of an inserted eavestrough towards the center of said fitting causing the base of the inserted eavestrough to remain in sealing contact with the portion of said ribs secured to said base.

2. An eavestrough fitting as claimed in claim 1 wherein said resilient aligning members provide a positive stop, limiting the extent of deformation of said base by applying a lateral force on the sidewalls of the eavestrough.

3. An eavestrough fitting as claimed in claim 2 wherein said resilient aligning members limit the extent of deformation of said ribs adjacent said resilient aligning members to about 50% of the uncompressed height of said ribs.

4. An eavestrough fitting as claimed in claim 1 wherein said resilient aligning members are placed between adjacent ribs and at least two resilient aligning members are placed either side of said base.

5. An eavestrough fitting as claimed in claim 4 wherein said resilient aligning members are small circular teats.

6. An eavestrough fitting as claimed in claim 5 wherein said teats are disposed centrally between said ribs

7. An eavestrough fitting as claimed in claim 6 wherein said teats are each positioned within one inch of said base.

8. An eavestrough fitting as claimed in claim 7 wherein said teats are of the same material as said ribs.

9. An eavestrough fitting as claimed in claim 8 wherein there are at least 3 parallel ribs for each length of eavestrough to be inserted into said fitting, each rib acting as a wiper seal and being of a tapered section.

10. An eavestrough fitting as claimed in claim 9 wherein said ribs cooperate with said teats when compressed by a length of eavestrough snap fitted into said moulded plastic member to define a pressure ridge applying pressure on the sidewall of the eavestrough urging the base of said eavestrough to maintain firm contact with said ribs across said base.

11. In combination an eavestrough fitting and a length of cooperating eavestrough; said fitting comprising a moulded plastic member having secured thereto a gasket, said gasket having at least two ribs extending across said member and up the sides thereof, said ribs being sized to form a seal with said cooperating eavestrough snap fitted within said fitting, said moulded plastic member and said eavestrough each having a generally flat base connected to outwardly angled sidewalls which terminate in a short vertical section; said gasket conforming to the shape of said moulded plastic member and including resilient aligning members associated with said ribs either side of said base on said outwardly angled sidewalls of said fitting, said resilient aligning members urging the sidewalls of said snap fitted eavestrough towards the center of said fitting causing the base of the snap fitted eavestrough to remain in sealing contact with the portion of said ribs secured to said base.

12. In combination as claimed in claim 11 wherein said eavestrough is held within said fitting by clips at the upper edge of said fitting, the base of said eavestrough having a tendency to bow upwardly generally in the center of said eavestrough which action is opposed by said resilient aligning members which exert a lateral force on the sidewalls of the eavestrough stressing the base of the eavestrough into sealing contact with said ribs along the base of said fitting.

13. In combination as claimed in claim 12 wherein there are three ribs within said fitting and said resilient aligning members are each disposed between said ribs within one inch of said base of said fitting.

14. In combination as claimed in claim 13 wherein said resilient aligning members are small circular teats.

15. In combination as claimed in claim 13 wherein said ribs cooperate with said teats due to the compression thereof by said eavestrough snap fitted into said moulded plastic member and define a pressure ridge applying pressure on the sidewall of said eavestrough urging the base of said eavestrough into firm contact with said ribs across said base of said fitting.

* * * * *